US008833289B2

(12) United States Patent
Isaac

(10) Patent No.: US 8,833,289 B2
(45) Date of Patent: Sep. 16, 2014

(54) BRACKET FOR A PWC

(71) Applicant: Troy Isaac, Sault Ste. Marie (CA)

(72) Inventor: Troy Isaac, Sault Ste. Marie (CA)

( * ) Notice: Subject to any disclaimer, the term of this patent is extended or adjusted under 35 U.S.C. 154(b) by 101 days.

(21) Appl. No.: 13/685,921

(22) Filed: Nov. 27, 2012

(65) Prior Publication Data

US 2013/0133564 A1 May 30, 2013

Related U.S. Application Data

(60) Provisional application No. 61/564,419, filed on Nov. 29, 2011.

(51) Int. Cl.
*B63B 17/00* (2006.01)
*B63B 25/00* (2006.01)

(52) U.S. Cl.
CPC ..... *B63B 25/00* (2013.01); *B63B 17/00* (2013.01)
USPC ..... 114/343; 114/364

(58) Field of Classification Search
USPC ..... 114/55.5, 55.55, 55.57, 249, 253, 343, 114/364
See application file for complete search history.

(56) References Cited

U.S. PATENT DOCUMENTS

| | | | | |
|---|---|---|---|---|
| 3,257,971 | A | 6/1966 | Swendsen | |
| 3,747,554 | A | 7/1973 | Allen | |
| 4,738,216 | A | 4/1988 | Camarota et al. | |
| 4,987,845 | A * | 1/1991 | Camarota | 114/253 |
| 4,993,343 | A | 2/1991 | Czipri | |
| 5,499,595 | A * | 3/1996 | Pollen | 114/55.5 |
| 7,886,677 | B2 * | 2/2011 | Strom | 114/55.5 |
| 2004/0025774 | A1 | 2/2004 | Berthiaume et al. | |
| 2006/0011683 | A1 | 1/2006 | Held | |
| 2007/0000426 | A1 | 1/2007 | Strom | |

* cited by examiner

*Primary Examiner* — Lars A Olson

(57) ABSTRACT

A bracket invention is mounted to the rear area of a personal watercraft or PWC, for the purpose of providing a method and means of attaching items such as but not limited too; rod holders, sonar, lights, cooler accessories, beverage holder, fuel containers, wiring, gun case, camping supplies, fishing/hunting accessories, and water sports equipment. The bracket invention is formed in such a way that these items can be firmly attached and/or located to the PWC, extending and adding to its useful functionality. The bracket is designed to be easily attached and removed from the PWC using existing holes and location points. The bracket invention allows for easy tie off when mooring at dock, a integral mounting point for a drag bucket used to modify the PWC's speed, and/or a lighting system extending the useful period of time that a rider can operate the PWC safely and legally.

18 Claims, 7 Drawing Sheets

BRACKET FOR A PWC

RELATED APPLICATIONS/PRIORITY BENEFIT CLAIM

This application claims the benefit of U.S. Provisional Application No. 61/564,419, filed Nov. 29, 2011 by the same inventor (Isaac), the entirety of which provisional application is hereby incorporated by reference.

FIELD OF THE INVENTION

The present invention relates to personal watercraft, often abbreviated "PWC". In particular, the invention is directed to a fishing/hunting/recreational mounting bracket for a PWC that extends the usefulness and safety of the PWC.

BACKGROUND

Personal watercraft (PWCs) generally do not provide devices for mounting items such as rod holders, sonar, lights, cooler accessories, beverage containers/holders, fuel containers, wiring, gun cases, camping supplies, and fishing and hunting accessories, requiring that they be held by the user. At best, PWCs tend to have a limited amount of storage space and no means of mounting items of interest or sporting accessories.

Personal watercraft have advanced in size, power and maneuverability; however, their storage and useful functionality have not kept pace with the needs of users. The introduction of the present invention to extend the usefulness of said watercraft is important and highly useful to this sporting category of watercraft. The present invention is simple and is an economical solution to a storage problem that has been associated with PWCs since their inception.

PWCs are often more affordable than boats, and in many cases, the PWC is both more powerful and maneuverable than conventional boats, making them increasingly popular. As they have evolved with this popularity, their deck size has increased, accommodating as many as three people onboard. However, storage space and equipment-mounting options have not kept pace, and due to the lack of storage space and/or mounting locations, users have to hold onto their equipment manually, both while the PWC is underway and also while on location. This situation can cause unsafe conditions which add to an already potentially dangerous activity; being able to securely attach accessories to the watercraft adds a necessary element of safety to waterborne activities. Otherwise, items not securely attached to the watercraft while in operation are easily lost and/or damaged and in doing so can injure the operator and passenger.

While some previous attempts have been made to improve the storage and equipment-mounting capabilities of PWCs, they have not solved the foregoing problems. Known methods for storing gear on PWCs are bulky and expensive and often improvised, and tend to require that the PWC be modified, potentially causing structural weakness and fatigue points.

US patent application publication number US 2007/0000426 A1 discloses a racking system for strapping luggage onto the top surface of a PWC. The racking system is extended in front of the operator's seat, and requires the manufacturer's original design to be modified as does the aforementioned racking system. Moreover, racks forward of the operator's seat are difficult for passengers to access.

U.S. Pat. Nos. 4,738,216, 3,747,554, 3,257,971 and 4,993,343 are all designed and intended to be used as waterski tow hooks.

U.S. patent application publication number US 2006/0011683 A1 discloses a racking system for strapping and holding luggage.

U.S. patent application publication number US 2004/0025774 A1 deals with a waterskiing apparatus.

BRIEF SUMMARY

When combined with the increased on-deck area of modern PWCs, the present bracket invention enables usefulness beyond that for which the craft was originally designed. Fishermen and hunters, for example, will now find PWCs more useful for their gear-intensive activities.

One of the main benefits of the present invention is that it uses existing features already built into the watercraft for mounting purposes. More specifically, the present invention is a substantially rigid U-shaped frame bracket mounted over the rear deck of the PWC. The bracket utilizes existing holes in the PWC made to receive the manufacturer's waterskiing or tow hook, and may optionally also use the two PWC lifting points located on the transom of the watercraft. The present invention accordingly does not introduce any additional holes into the body of the watercraft for the bracket to be installed, nor does it add structural fatigue to the PWC.

The bracket of the present invention provides multiple mounting points on the watercraft for mooring the PWC, and providing handholds when boarding the PWC at the rear deck, whether from a dock or from the water. The bracket also gives users the ability to secure/mount items to the watercraft, leaving their hands free to control the watercraft and to pilot safely while the watercraft is in operation. This significantly increases the security of everyone on the water.

The bracket of the present invention has a continuous "wire" frame structure defining multiple possible mounting points over its perimeter, and defining an interior storage area within the perimeter of the frame. Although the exact shape of the bracket can vary, it can be considered generally "U-shaped" in that it has two free ends with an otherwise continuous frame between the ends defining an inner storage area. The bracket may be formed from rigid, or substantially rigid (but somewhat flexible), rods such as steel, plastic, hollow tube or a threaded metal rod with a plastic covering/coating or other appropriate material. The bracket may be shaped in a manner that allows accessories to be mounted onto it and ultimately the watercraft itself. The bracket may be shaped in a fashion that allows the bracket to be mounted on the watercraft utilizing a pre-existing location or mounting points.

The bracket may utilize the two apertures formed in the watercraft for the original equipment that allows a user to tow water skiers or tube riders from the rear of the PWC. The opposing ends of the bracket may be inserted through these existing open apertures left by removing the manufacturer's waterskiing hook, and the bracket may be secured by the required number of nuts and/or securing devices directly onto the PWC.

The bracket of the present invention allows a device for electrical power and control wiring to be securely and safely mounted/attached to the PWC.

The bracket of the present invention allows the PWC to be quickly secured to a dock by using the bracket as a securing location at the rear of the PWC, with raised locating points above the hull at seat level where they can be easily accessed by users disabled from full mobility. Prior securing points on PWCs are under the hull low to the water and are very difficult to reach.

The bracket of the present invention allows for the attaching and deployment of known speed regulating apparatus, much like a pail or water parachute that creates drag, being launched from the back of the PWC. The speed regulator may be attached to the two lifting hooks located on the rear transom and to the bracket of the present invention, enabling the speed regulating apparatus to be easily stored, deployed, and retrieved.

The location of the bracket of the present invention does not inhibit access to any storage compartments or apparatus located on the PWC, making it a structurally fixed and static part of the PWC.

The bracket of the present invention provides an apparatus for securing such items as hunting and fishing equipment, camping supplies, water skis, wake boards, inner tubes and diving equipment to the rear of the operator. Locating such equipment weight to the front of the PWC could significantly change the handling of the PWC, creating a dangerous environment. Securing this equipment to the main rear deck of the PWC using the bracket of the present invention allocates weight where the PWC was designed to carry the extra weight of passengers—on and over the PWC rear deck area, between the seat and the transom, thusly maintaining the original operational characteristics of the PWC.

The bracket of the present invention allows a lighting system to be mounted onto the bracket, providing a feature that is not presently available on known PWCs at this time. This bracket of the present invention thus aids increased visibility and safety while operating on the water, both for the PWC operator and for others both on and off the PWC.

Storing any foreign (i.e., non-PWC native) materials or articles in front of the driver and passenger on a PWC can potentially create a dangerous environment at 60 mph in possibly rough water. Using the rear-mounted bracket of the present invention, foreign articles may be located behind the operator and passengers, saving them from possible injury if an article became undone and fell off from the PWC while in motion.

The bracket of the present invention is intended to function in combination with the PWC as a system, acting between the PWC and any accessory that needs attaching, seamlessly integrating to the existing design of the PWC without having to modify the PWC. The bracket of the present invention gives the PWC the functionality of a fishing or hunting boat at the price of a PWC.

It is the object of the present bracket invention to provide a PWC user with a safe, easy to install, economical, highly utilitarian apparatus that can be used for multipurpose applications.

The bracket of the present invention may further include an optional single strap or straps arranged for fastening the bracket to a portion of the water craft, most notably to the lifting hooks located on the watercraft's lower transom. These lifting hooks may be used to secure an end of the strap, therein adding strength and stability to the bracket.

The bracket comprises two free ends and a continuous "wire" frame enclosing an interior storage area and supported above the rear deck. In a first form, the bracket has a longitudinal frame portion or "stem" with two spaced, generally parallel legs extending generally parallel to the PWC centerline (bow to stern axis), the longitudinal frame portion supported in cantilever fashion above the rear deck by two ends mounted in the water ski hook-mounting holes normally formed in the rear of the PWC seat. In a further form, the bracket includes an enlarged "head" or "hammerhead" frame portion contiguous with and extending laterally (port-to-stern or beam axis of the PWC) from the stem portion.

In one form the bracket may have a substantially rectangular configuration with an inverted longitudinal stem portion extending into, and substantially surrounded by the enlarged rectangular head portion, the bracket supported horizontally above the rear deck on legs that sit on the rear deck of the watercraft. The inverted stem may further include free ends of the bracket angled to sit or be mounted to the deck, for example in apertures in the deck similar to apertures 5 in the rear 6 of the seat 2. Straps can be used to further secure the bracket to the PWC.

By "wire" or "rod" I intend to include any elongated rod, tube or wire structure (or equivalent) that is rigid enough to hold its shape when mounted above the deck of the PWC, and rigid enough to provide a secure mount for equipment secured by mechanical connection to the frame, and to provide a secure restraint for equipment placed within the interior storage area defined inside the perimeter of the frame.

The features of the invention can be understood and appreciated by referring to the accompanying drawings, which are not to any particular scale, and to the detailed description of the invention.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

FIGS. 1-11 represent example embodiments of the bracket invention in different designs in use with a generic, schematically illustrated PWC, in order to teach how to make and use the invention. These examples are representative of the invention without intended to be limiting as to the form of the bracket or the type of PWC on which it is mounted.

Figure 1A:
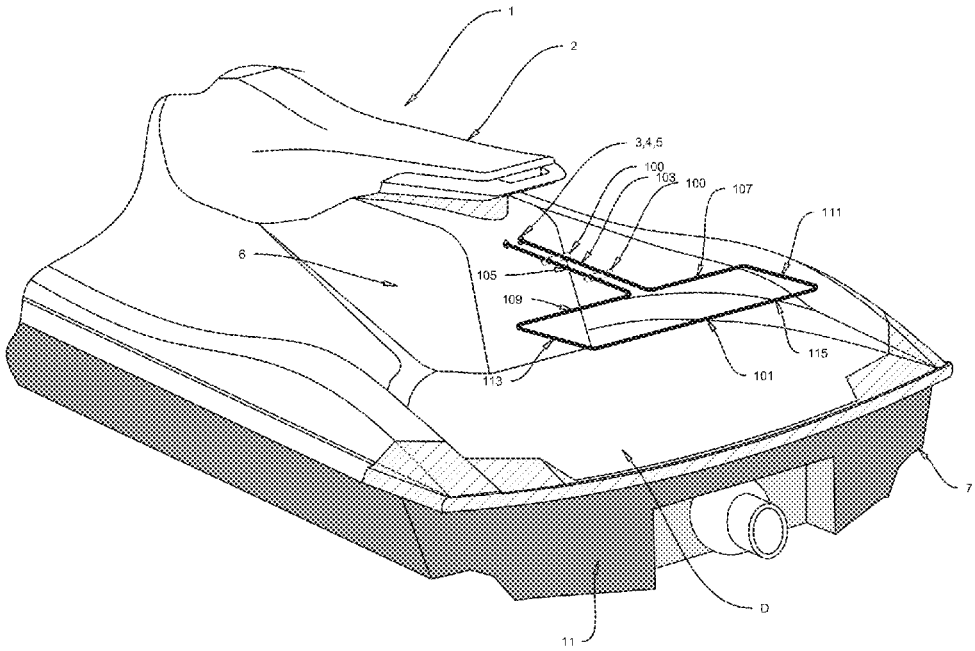
FIG. 1A illustrates a perspective view of the invention with a hammerhead type of end that allows a perpendicular area for mounting forward and rear facing accessories such as a sonar, as well as lateral mounting locations for rod holders and other accessories.
Figure 1B:
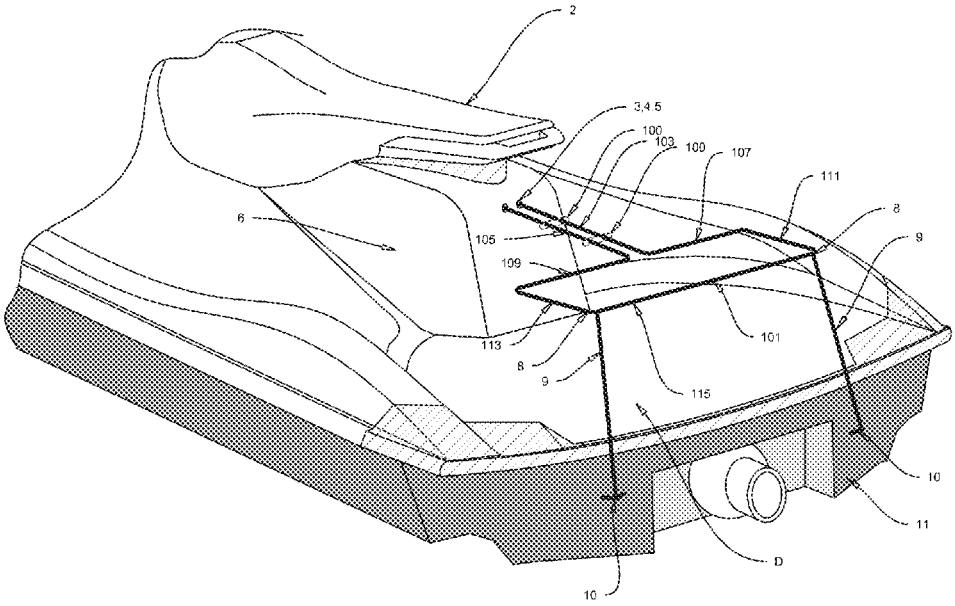
FIG. 1B illustrates the bracket of FIG. 1A utilizing two additional PWC location points on the transom with strapping.

FIGS. 1A and 1B show a "hammerhead" design having longitudinal and transverse frame portions, shown with (FIG. 1B) and without (FIG. 1A) additional strapping. FIGS. 1A and 1B additionally illustrate a seat 2 of the PWC 1; inner fasteners 3, outer fasteners 4, and a known type of water ski/tow hook mounting apertures 5 in the rear 6 of the PWC seat 2; the hull 7 of the PWC; one or more strap connecting positions 8 on the bracket; one or more straps 9; and known lifting hooks 10 in PWC transom 11. The PWC has a rear deck D where passengers normally ride or sit.

In FIGS. 1A and 1B, the bracket 101 is a continuous wire frame that may be formed by a rod, of hollow or solid cross-section, either a continuous rod or multiple rod sections assembled into a continuous frame. While a uniform, constant diameter/thickness is shown for the rod frame of bracket 101, the diameter or thickness could vary over the perimeter of the frame. Bracket 101 includes a first front longitudinal leg 103 and a second front longitudinal leg 105 (generally parallel to the longitudinal axis of the PWC). Longitudinal legs 103 and 105 are substantially parallel to one another and extend from the water ski mounting hook apertures 5. In the hammerhead version of FIGS. 1A and 1B, longitudinal legs 103 and 105 terminate at the bracket front end in free ends 103*a* and 105*a* (best shown in FIGS. 6 through 10, and common to all of the illustrated embodiments) secured in mounting apertures 5 in the rear seat 2 of the PWC, for example with inner and outer fasteners 3 and 4 in a manner similar to the original ski/tow hook structure, or with any other connecting structure or method including, but not limited to, structural adhesives. Longitudinal bracket legs 103 and 105 terminate at their rear ends where the frame extends laterally to form a substantially rectangular enlarged storage portion which includes a first front transverse section 107 (transverse to the longitudinal axis of the PWC) connected to the first front longitudinal leg 103, and a second front transverse section 109 connected to the second longitudinal leg 105. The first front transverse section 107 is connected to a first back longitudinal section 111, and the second front transverse section 109 is connected to a second back longitudinal section 113. The first back longitudinal section 111 and the second back longitudinal section 113 are connected to the back transverse section 115.

In FIG. 1B, the back transverse section 115 of bracket 101 is shown with optional straps 9 secured to the bracket at strap connection positions 8 (in the illustrated embodiment, the corners of the hammerhead area). The straps 9 are connected at their lower ends to the lifting hooks 10 which are commonly found attached to or adjacent the transom 11. Straps 9 may reduce the tendency of the cantilevered frame to vibrate or bounce in rough seas; as such they are not a support for the frame, but rather function as a tensioning device.

The bracket shown in FIGS. 1A and 1B is mounted in cantilever fashion to the rear of seat 2 of the PWC by the front ends of longitudinal legs 103 and 105, which form the free or terminal ends of the substantially rigid bracket frame. The remainder of the bracket 101, which is generally planar (in a single plane), is located above deck D, preferably parallel to the deck although different angular orientations are possible.

FIGS. 1A and 1B show clip-type spacers 100 connected between legs 103 and 105, for example made from wire ovals or molded plastic pieces with apertures for legs 103 and 105 to pass through. Clips 100 may be used to add rigidity to the stem portion of the frame defined by legs 103 and 105, or may be used to partition the storage area defined between legs 103 and 105 to better retain/secure items such as fishing rod handles and the like placed therein. Clips 100 are also shown in subsequent Figures.

Figure 2A:
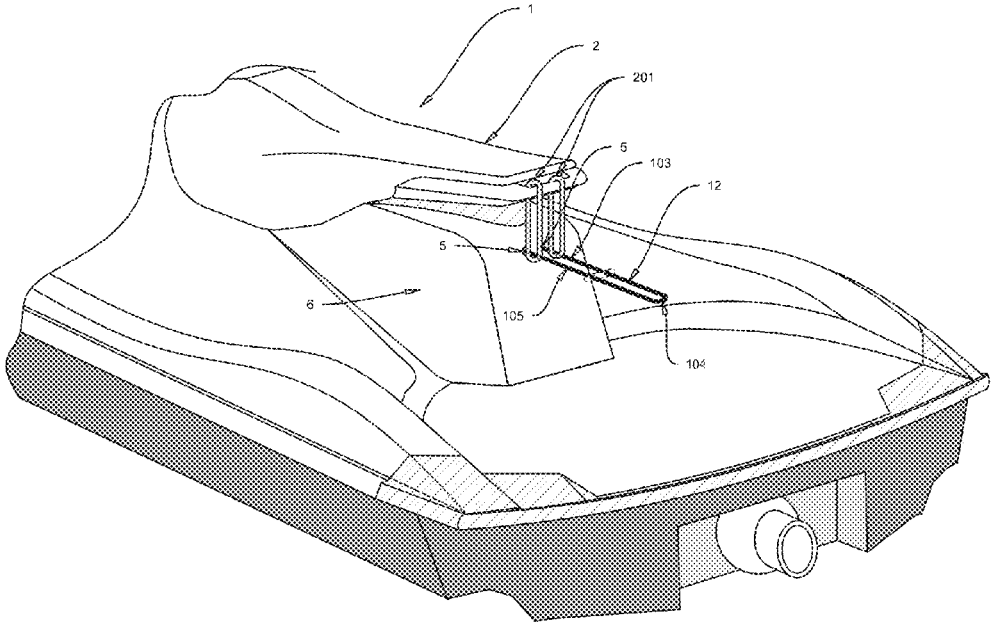
FIG. 2A illustrates a perspective view of an alternate form of the bracket invention, with two lateral areas for mounting accessories and an easy mooring bracket to tie off to the dock.

FIG. 2A illustrates a short, narrow bracket 12 that consists essentially of the longitudinal stem portion of the hammerhead design of FIGS. 1A and 1B, comprising legs 103 and 105 formed by a rod which forms a narrow, elongated U-shape. The longitudinal legs terminate at the rear end of the bracket in a rounded bight 104, rather than extending transversely into an enlarged hammerhead region. FIG. 2A also shows optional stabilizing straps 201 connected at one end to the inner end of the bracket 12 adjacent the rear 6 of seat 2, and connected at their other end to a rear portion of seat 2, for example a handle of known type, a hook or cleat, or some other convenient mounting point above the bracket at the rear of the seat. Straps 201 may be used to stabilize the bracket against swaying motion, and to prevent the bracket from bouncing in heavy waves. Straps 201 also help support the weight of any equipment mounted on bracket 12. Straps 201 may be made of any material, including but not limited to plastic tie wraps, nylon straps, and metal strapping, and may be flexible or more or less rigid. While two straps 201 are shown, with one strap connected to each leg of the bracket, a single strap 201 might be looped around or otherwise connected to the legs of the bracket. Straps 201 preferably run vertically from the inner end of the bracket 12 to an overlying connection point on the rear of the seat, so as not to interfere with access to equipment stored in or mounted on the bracket.

Figure 2B:
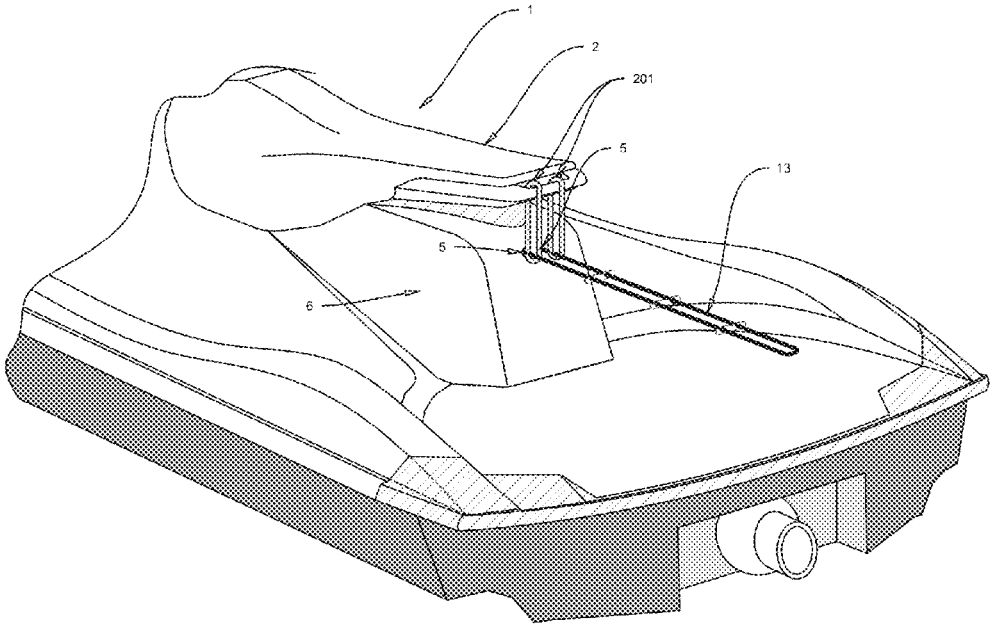
FIG. 2B illustrates a longer form of the bracket in FIG. 2A, with more mounting area.

FIG. 2B illustrates a double-length bracket 13 similar to bracket 12 in FIG. 2A, only longer. Straps 201 are also shown in use with the bracket of FIG. 2B, and it should be understood that straps 201 could be used with any of the brackets described herein.

Figure 3:
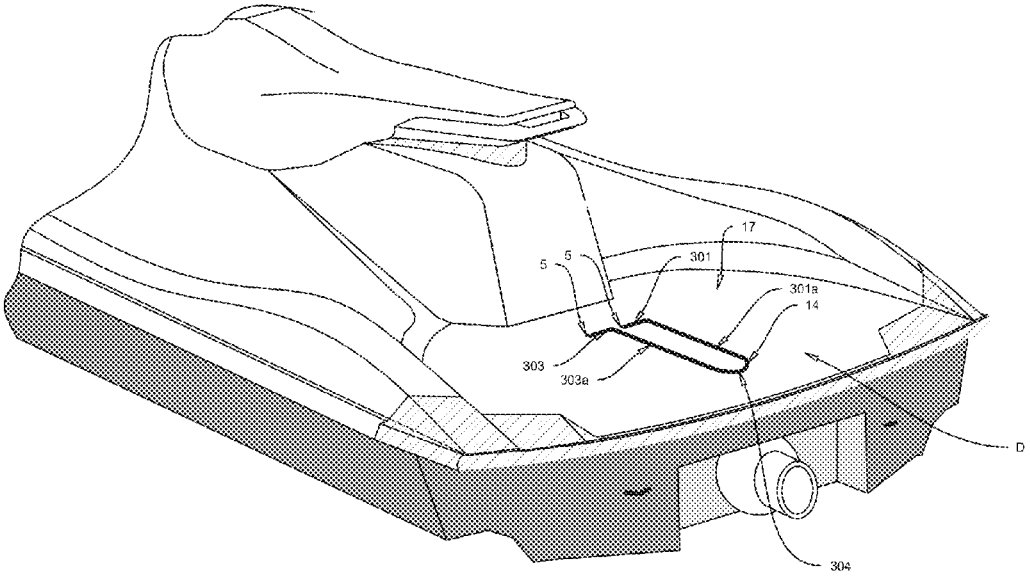
FIG. 3 is a perspective view of a multi-planar version of the longitudinal bracket of FIGS. 2A and 2B, whose shape is applicable both to rear seat mounting hole locations as well as deck mounting hole locations.

FIG. 3 illustrates a bracket 17 formed by a rod including a first front longitudinal inclined leg 301 and a second front longitudinal inclined leg 303 in a spaced relationship with the first longitudinal inclined leg 301. The front longitudinal inclined leg 301 and the front longitudinal inclined leg 303 are inclined relative to rear longitudinal leg portions 301*a* and 303*a* at an acute angle. Bracket 17 is accordingly a multi-planar version of brackets 12 and 13 in FIGS. 2A and 2B, with front leg portions 301 and 303 lying in a first plane, and rear leg portions 301*a* and 303*a* lying in a second plane set at an acute angle to the first plane. Either plane may be at an acute angle with respect to the deck of the PWC, depending whether the free ends of the front leg portions are mounted in the apertures 5 in the PWC rear seat as in FIGS. 1A through 2B, or in apertures 5 in deck D. In the illustrated example of FIG. 3, first longitudinal inclined leg 301 and the second longitudinal inclined leg 303 are acutely angled (e.g., 45° or so) relative to deck D, and connect to a U-shaped section 304 formed by rear leg portions 301*a* and 303*a* that is substantially parallel to the back deck D.

Figure 4A:
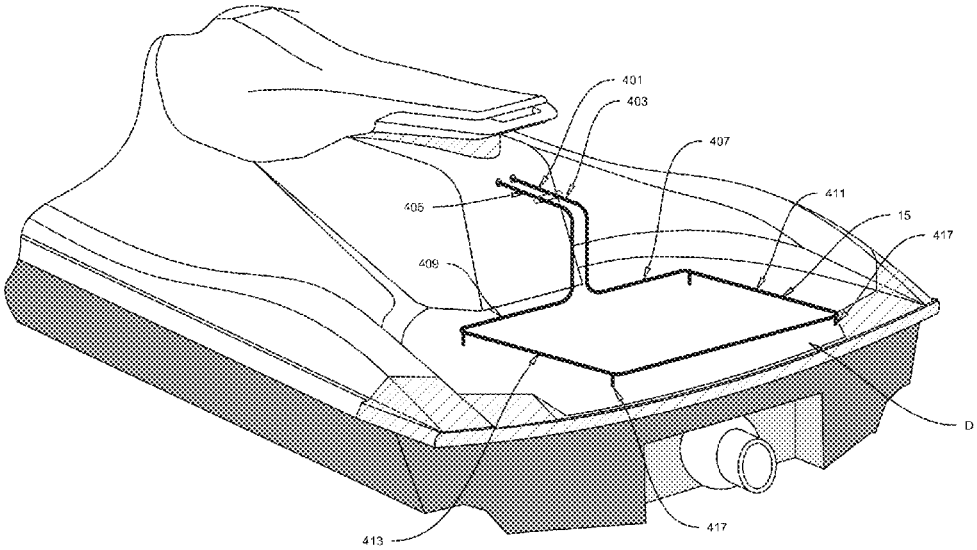
FIG. 4A illustrates a perspective view of a modified multi-planar version of the hammerhead type bracket in FIGS. 1A and 1B, with lateral and perpendicular mounting surfaces lowered to the rear deck level.

In FIG. 4A, an alternate bracket 401 comprises a rod structure including a first front longitudinal section 403 which may be substantially L-shaped and a second front longitudinal section 405 (parallel to the longitudinal axis of the PWC) which may be substantially L-shaped and which is substantially parallel to the first front longitudinal section 403 and the which extends from the aperture 5 and further extends to a substantially rectangular enlarged head portion in a different plane than the horizontal portions of legs 403 and 405. The enlarged head portion includes a first front transverse section 407 (transverse to the longitudinal axis of the PWC) connected to the first front longitudinal section 403 and a second front transverse section 409 connected to the second longitudinal section 405. The first front transverse section 407 is connected to a first back longitudinal section 411, and the second front transverse section 409 is connected to a second back longitudinal section 413. The first back longitudinal section 411 and the second back longitudinal section 413 are connected to the back transverse section 415. The substantially rectangular portion may optionally include one or more downward extending arms or leg 417 to connect or support the substantially rectangular portion to or on the deck D of the PWC. Depending on the weight and rigidity of the rod material used for the bracket, legs 417 may not be needed, and the enlarged head portion comprising sections 407-418 may be suspended above deck D by legs 403 and 405.

Figure 4B:
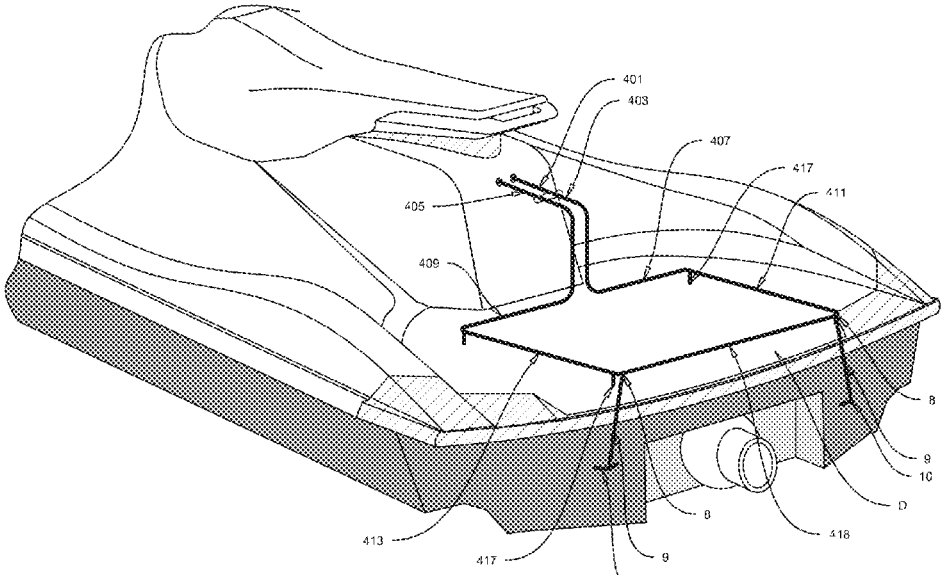
FIG. 4B illustrates the bracket of FIG. 4A utilizing two other location points on the transom with strapping.

In FIG. 4B, the back transverse section 418 of the bracket 401 is shown with optional straps 9 secured to the bracket at strap connection positions 8 (in the illustrated embodiment, the corners of the enlarged head area). The straps 9 are connected at their lower ends to the lifting hooks 10 which are commonly found attached to or adjacent the transom 11.

Figure 5A:
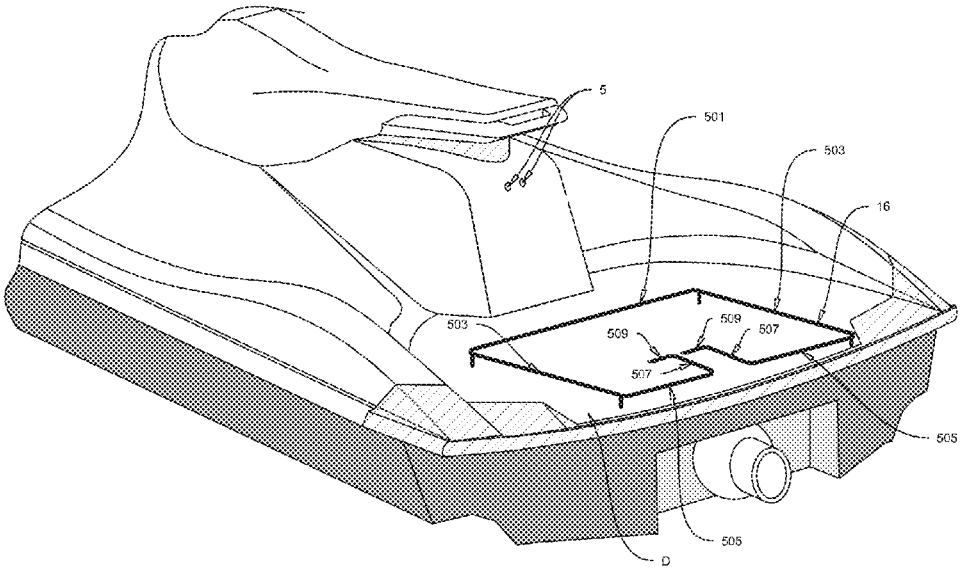
FIG. 5A illustrates a perspective view of a modified planar version of the hammerhead type bracket in FIGS. 1A and 1B lowered to the rear deck level, with an inverted longitudinal stem.

FIG. 5A illustrates a bracket 16 which may be a rod which may be in the shape of a discontinuous rectangle with an inverted longitudinal "stem" portion 507, 509, and which may include a front traverse section 501 which may be connected to an opposing pair of side longitudinal sections 503 which may be connected to an opposing pair of back traverse sections 505 which may be connected to a pair of opposing back longitudinal sections 507 which may be connected to a pair of opposing inclined longitudinal sections 509 which may form an acute angle with respect to the deck and which may be connected to the deck of the PWC. The bracket 16 may be mounted on downward extending arms 517 which may support the bracket 16 on the deck of the PWC.

Figure 5B:
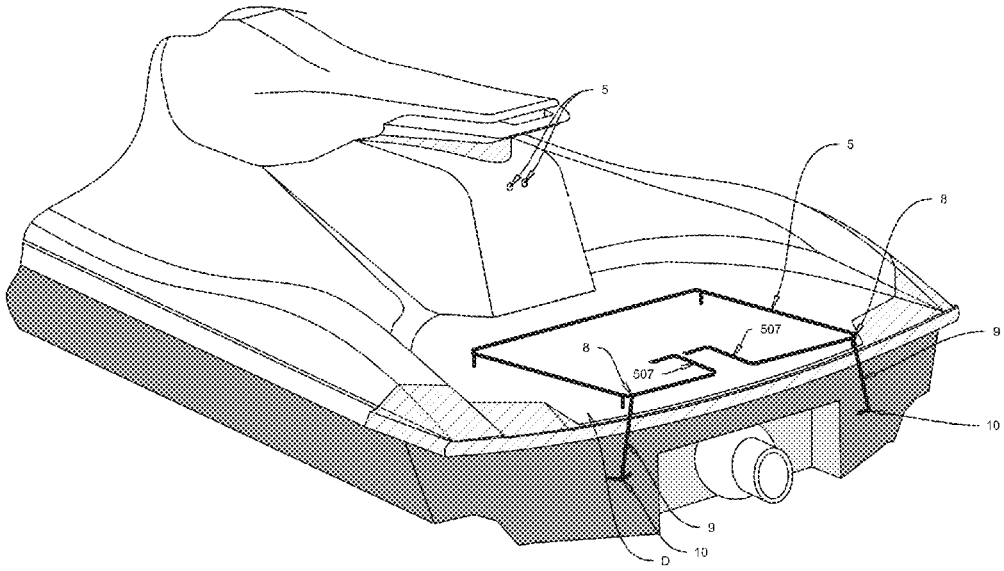
FIG. 5B illustrates the bracket of FIG. 5A utilizing two other location points on the transom with strapping.

FIG. 5B illustrates one or more optional straps 9 extending between a strap connecting point 8 to lifting hooks 10.

Figure 6:
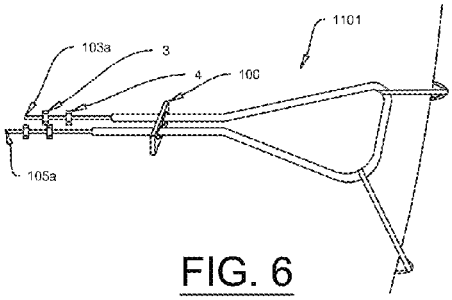
FIG. 6 illustrates a detailed perspective view of a bracket similar to the bracket of FIG. 1B, but with a modified triangular hammerhead.

FIG. 6 illustrates a perspective view of a bracket 1101 similar to bracket 101 in FIG. 1B, but with a modified triangular head portion.

Figure 7:
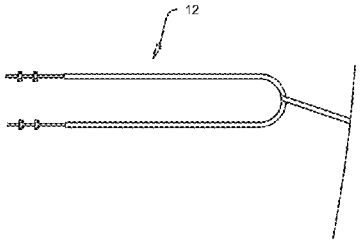
FIG. 7 illustrates a detailed perspective view of the bracket of FIG. 2B.

FIG. 7 illustrates a perspective view of the bracket of FIG. 2B.

Figure 8:
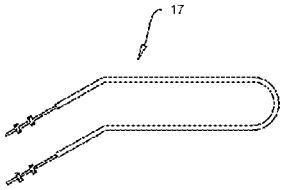
FIG. 8 illustrates a detailed perspective view of the bracket of FIG. 3.

FIG. 8 illustrates a perspective view of bracket of FIG. 3.

Figure 9:
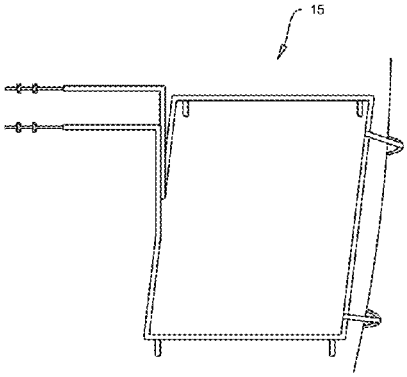
FIG. 9 illustrates a detailed perspective view of the bracket of FIG. 4B

FIG. 9 illustrates a perspective view of the bracket of FIG. 4B.

Figure 10:
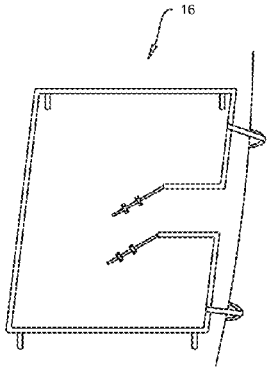
FIG. 10 illustrates a detailed perspective view of the bracket of FIG. 5B

FIG. 10 illustrates a perspective view of the bracket of FIG. 5B.

Figure 11:
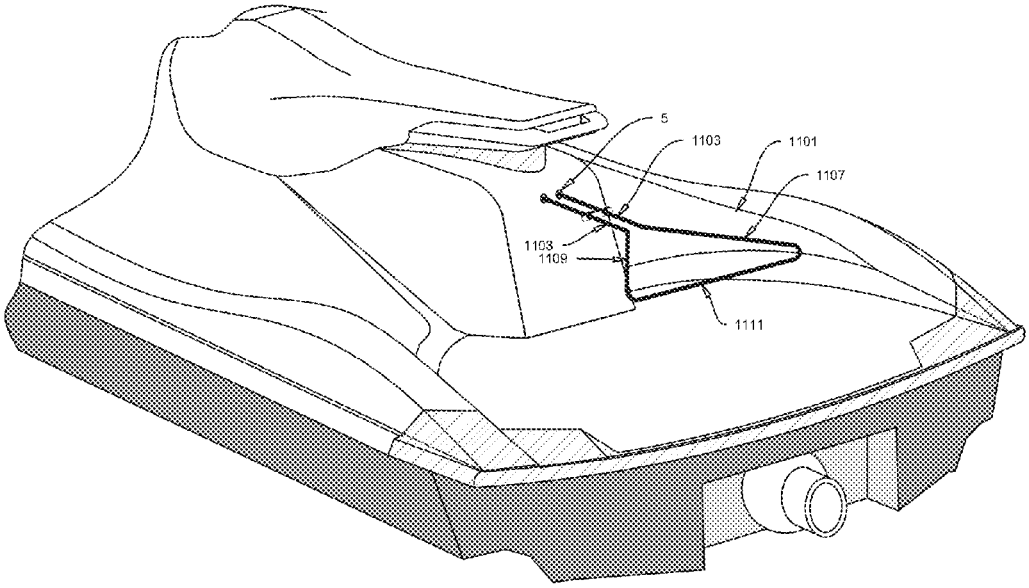
FIG. 11 illustrates the bracket of FIG. 6 mounted on a PWC.

In FIG. 11, the bracket 1101 comprises a rod structure with an enlarged head portion in the shape of a discontinuous triangle and which includes a first front longitudinal section 1103 and a second front longitudinal section 1105 (parallel to the longitudinal axis of the PWC) substantially parallel to the first front longitudinal section 1103 and the which extends from the aperture and further extends to a substantially continuous triangular enlarged head portion including a first front angled section 1107 (angled at an acute angle to the longitudinal axis of the PWC) connected to the first front longitudinal section 1103 and a second front angled section 1109 (angled at an acute angle to the longitudinal axis of the PWC) connected to the second longitudinal section 1105. The first front angled section 1107 is connected to a back transverse section 1111, and the second front angled section 1109 is connected to the back transverse section 1111.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

Description Of Operation

In operation, the bracket as illustrated in the examples of FIGS. 1A-11 is used by mounting it to a PWC, primarily by securing the free ends of the longitudinal legs or stem portion of the bracket in existing mounting holes formed in the rear seat or rear deck of the PWC, and secondarily if desired by securing tensioning straps to rear portions of the bracket frame and to hooks or cleats in the lower rear of the PWC below the bracket. Sporting, safety, and recreational equipment can then be secured directly to portions of the bracket frame about the perimeter of the bracket, either inside or outside the frame, for example with rope, clips, cable, or ties; or, the equipment may simply be placed within the frame-enclosed interior storage area of the bracket, including both the narrower longitudinal "stem" and the wider transverse "head" regions, the equipment resting on the deck and constrained by the frame from shifting longitudinally or laterally about the deck.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

What is claimed is:

1. A bracket for mounting equipment to a PWC having a seat and a deck and including rear-facing apertures for mounting a ski/tow hook or similar apparatus to a rear of the seat or to the deck, the deck being behind and below the seat, the bracket comprising:

a wire frame structure comprising a substantially rigid, continuous rod or wire perimeter terminating in two free ends adapted to be secured in PWC ski/tow hook apertures, the perimeter defining peripheral mounting points on the frame to which equipment can be secured, and the perimeter further defining at least one generally planar interior storage area within the perimeter of the frame in which equipment can be placed, the frame further comprising a longitudinal stem portion with two spaced, generally parallel longitudinal legs terminating at a front end into two free ends and connected at a rear end to a generally U-shaped portion of the frame and wherein said frame lies substantially in a single plane.

2. The bracket of claim 1, wherein the generally U-shaped frame portion has a transverse width approximately equal to the spacing between the longitudinal legs.

3. A bracket for mounting equipment to a PWC having a seat and a deck and including rear-facing apertures for mounting a ski/tow hook or similar apparatus to a rear of the seat or to the deck, the deck being behind and below the seat, the bracket comprising: a wire frame structure comprising a substantially rigid, continuous rod or wire perimeter terminating in two free ends adapted to be secured in PWC ski/tow hook apertures, the perimeter defining peripheral mounting points on the frame to which equipment can be secured, and the perimeter further defining at least one generally planar interior storage area within the perimeter of the frame in which equipment can be placed, the frame further comprising a longitudinal stem portion with two spaced, generally parallel longitudinal legs terminating at a front end into two free ends and connected at a rear end to a generally U-shaped portion of the frame, and wherein the frame further comprises an enlarged head portion having a substantially greater transverse width and area than the stem portion.

4. The bracket of claim 3, wherein the generally U-shaped frame portion comprises a substantially rectangular hammerhead shape of substantially greater area than the area defined between the longitudinal legs.

5. The bracket of claim 3, wherein the generally U-shaped frame portion comprises a substantially triangular shape of substantially greater area than the area defined between the longitudinal legs.

6. The bracket of claim 1, wherein a first portion of the frame lies in a first plane, and wherein a second portion of the frame lies in a second plane.

7. The bracket of claim 6, wherein the first portion of the frame is a stem portion comprising the longitudinal legs, and wherein the second portion of the frame is an enlarged head portion comprising a remainder of the frame with a substantially greater transverse width and area than the stem portion.

8. The bracket of claim 6, wherein the first plane and the second plane are generally parallel to one another.

9. The bracket of claim 6, wherein the first plane and the second plane are acutely angled relative to one another.

10. The bracket of claim 3, wherein the stem portion is external to the enlarged head portion of the frame.

11. The bracket of claim 3, wherein the stem portion is substantially surrounded by the enlarged head portion.

12. The bracket of claim 11, wherein the bracket comprises vertical legs adapted to sit on the rear deck of a PWC and to support the frame above the deck.

13. The bracket of claim 12, wherein the free ends of the longitudinal legs of the stem portion are angled downwardly to terminate at approximately the same level as the vertical legs.

14. In combination with a PWC having a seat and a deck and including rear-facing apertures for mounting a ski/tow hook or similar apparatus to a rear of the seat or to the deck, the deck behind and below the seat, a bracket comprising: a wire frame structure comprising a substantially rigid, continuous rod or wire perimeter terminating in two free ends secured in the PWC ski/tow hook apertures, the perimeter defining peripheral mounting points on the frame to which equipment can be secured, and the perimeter further defining at least one generally planar interior storage area within the perimeter of the frame in which equipment can be placed, the frame further comprising a longitudinal stem portion with two spaced, generally parallel longitudinal legs terminating at a front end into two free ends and connected at a rear end to a generally U-shaped portion of the frame and wherein said generally u-shaped portion of the frame is an enlarged head portion comprising a substantially greater transverse width and area than said stem portion.

15. The combination of claim 14, wherein the generally U-shaped portion of the frame is supported in cantilever fashion above the rear deck by the free ends secured in the apertures.

16. The combination of claim 14, wherein the generally U-shaped portion of the frame is connected by one or more straps to hooks on the PWC transom below the deck.

17. The combination of claim 14, wherein the generally U-shaped portion of the frame is supported above the deck on generally vertical legs.

18. The combination of claim 14, wherein the stem portion of the frame lies in a first plane above the deck, and wherein the head portion of the frame lies in a second plane above the deck below the first plane.

* * * * *